US006770609B1

(12) United States Patent
Morrison

(10) Patent No.: US 6,770,609 B1
(45) Date of Patent: Aug. 3, 2004

(54) LIGHT REFLECTING PARTICLES

(75) Inventor: Christopher Andrew Morrison, Cullercoats (GB)

(73) Assignee: Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/937,264

(22) PCT Filed: Apr. 13, 2000

(86) PCT No.: PCT/US00/09852

§ 371 (c)(1), (2), (4) Date: Sep. 24, 2001

(87) PCT Pub. No.: WO00/61718

PCT Pub. Date: Oct. 19, 2000

(30) Foreign Application Priority Data

Apr. 13, 1999 (GB) ..... 9908354

(51) Int. Cl.[7] ..... C11D 7/20
(52) U.S. Cl. ..... 510/348; 510/440; 510/446
(58) Field of Search ..... 510/348, 438, 510/440, 441, 446

(56) References Cited

U.S. PATENT DOCUMENTS 6,313,080 B1 * 11/2001 Boskamp et al. ..... 510/298

* cited by examiner

*Primary Examiner*—John R. Hardee
(74) *Attorney, Agent, or Firm*—Caroline Wei-Berk; Kim W. Zerby; Steve W. Miller

(57) ABSTRACT

Visible light reflecting particles comprise one or more detergent ingredients and a light reflecting component, which results in the particle having a specular visible light reflection which is greater in intensity than the specular visible light reflection of the ingredients per se. Preferably, the reflection is greater than the reflection of sodium citrate dihydrate, as defined herein. The reflecting particle preferably comprises the light reflecting component evenly applied on its surface. The particles are particularly suitable for incorporation into laundry or dish washing compositions, fabric conditioning compositions or hard-surface cleaning compositions.

18 Claims, No Drawings

LIGHT REFLECTING PARTICLES

TECHNICAL FIELD

The invention relates to visible light reflecting particles for use in detergent compositions, to processes for making the particles and to detergent compositions comprising the particles.

BACKGROUND TO THE INVENTION

In recent years, detergent manufacturers have introduced in their products small amounts of dyed particles or speckles. The particles can mask de-coloration in the product and/or allows the incorporation in the products of small amounts of ingredients which do not have the colour of the bulk of the product by masking this colour difference. Furthermore, it has been found that the detergent users associate products having dyed particles with improved cleaning that the consumer acceptance of product comprising coloured particles is normally higher than product not comprising such coloured particles.

These particles are often obtained by spraying-on an aqueous solution of a specific dye onto hygroscopic material and addition of these materials to the other ingredients, or directly onto the final detergent base particles and subsequently drying the thus dyed materials or particles. A problem associated with this method is that the hygroscopic material absorbs large amount of water which may result in caking of the product. This is particularly a problem when higher amounts of aqueous dye-solution need to be used, for example, when very diluted dye solutions are to be used, or strongly dyed particles are needed or the dye is absorbed by the material or particles which are to be dyed.

Another problem associated with detergents comprising large amounts of dye per particle can be that the dye can 'bleed' in the presence of water. This may be the case when the detergent is made by spraying on large amounts of aqueous dye solutions, or when the detergent comprises large amount of hygroscopic material or of course, when the detergents are introduced to the washing or cleaning liquid, This 'bleeding' may cause colour changes of the product and the packing material. Moreover, under certain conditions, the dye or the dye particles which may deposit on the fabrics, can 'bleed' on the fabrics and cause colour changes on the washed fabric.

Also, those particles which cause decolouration and require masking to not allows the presence of dye or sufficient amounts of dye.

However, despite these problems, it may be desirable to have some form of speckle particles present in the product to provide the required contrast in the product and/or masking of certain ingredients in the product.

The inventor has now found an improved method of providing the required masking of undesired coloration of detergent products. The inventor has now found that the same or a better masking or contrasting effect can be achieved when particles are incorporated in the product which reflect light, which can be achieved by providing particles which comprise or consist of a reflecting component. The presence of the specific light reflecting component then produces a certain light reflection by the particles containing the light reflecting component, which provides a contrast with the other ingredients of the products, or can mask the undesired colour of the particle containing the light reflecting component or of other ingredients of the product, thus resulting in an overall whiter or brighter product appearance. The light reflecting component can generally be used in very small quantities to provide the required effect The use of the particles of the invention results in more formulation flexibility for the detergent manufacturer because the colour of the ingredients to be used is now less important. Also, any, often difficult, process steps to provide detergent ingredients of the required colour can now be dispensed of, for example one or more purification steps.

The particles of the invention can be used in addition to any dyed speckle, but they can also be used instead of any dyed speckle particles. The present invention even allows reduction or elimination of the use of dyed particles and thus the problems associated therewith. Thus, since the particles of the invention are able to provide the contrasting or masking when not coloured, these speckle particle may be useful in certain products in countries where the use of dyes in such products is not allowed.

SUMMARY OF THE INVENTION

The present invention provides a detergent particle comprising a visible light reflecting component and one or more particulate component which comprise one or more detergent ingredients, whereby the detergent particle exhibits a specular visible light reflection which is of higher intensity than the specular visible light reflection of the particulate component or components.

The reflecting detergent particles preferably has a lustre index, measured by a method described herein, which exceeds the lustre index of sodium citrate dihydrate sample, whereof 100% of the particles has a particle size of from 355 to 500 microns, having an mean particle size of 425 microns.

The reflecting particle preferably comprises the light reflecting component evenly applied on its surface.

The particle is useful for incorporation in laundry or dish washing compositions, fabric conditioning compositions or hard-surface cleaning compositions. In particular, solid compositions are envisaged herein, but the particles may also be useful in liquid compositions which allow the use of solid particles.

In another embodiment of the invention, a specific detergent composition is provided which comprise s a reflecting particle consisting of the specific light reflecting component.

Also provided are detergent tablets or bars comprising the reflecting component, in particular on the surface of the tablet or bar.

The reflecting component can be introduced in the detergent product by several methods. The inventor however has also found specific methods which are particularly effective. Hereby, a common detergent ingredient or commonly used solvent, such as water, is used to incorporate the light reflecting component into the detergent product. Thus, the invention also relates to processes for making the compositions and the particle and the use thereof.

DETAILED DESCRIPTION OF THE INVENTION

Visible Light Reflecting Particles

When used herein 'reflecting' or 'light reflecting' or 'visible light reflecting' means specular visible light reflecting. For the purpose of the invention, when reference is made to specular visible light reflection or the intensity thereof, this does not include diffuse light reflection, which can also be understood from the definition of the lustre index below.

In one embodiment, the particle herein exhibits a specular visible light reflection which is of higher intensity than the specular visible light reflection of the particulate component, comprising one or more detergent ingredients.

In another embodiment, a granular detergent composition or tablet is provided which comprises one or more particulate detergent components and a particle consisting essentially of a visible light reflecting component, whereby the particle exhibit a specular visible light reflection which is of higher intensity than the specular visible light reflection of the particulate component or each of the particulate components.

Also provided is a detergent tablet or bar having a core containing one or more particulate detergent components and a surface containing a visible light reflecting component, whereby the surface exhibit a specular visible light reflection which is of higher intensity than the specular visible light reflection of the particulate component or each of the particulate components.

The detergent particles, compositions, tablets and bars of the invention can also be defined by a lustre index, which is characteristic for a specific specular visible light reflection of the specific particle, composition, tablet or bar.

The lustre index is measured using a standard goniophotometric method. Incident visible light is directed at the product sample (e.g. the reflecting particle) at a given angle to the sample. This angle varies from 0° to 1 80° in increments. The intensity of visible light reflected from the sample is then measured. Light which is reflected at the same angle as the angle of the incident light is said to be specular. Light reflected at all other angles is said to be diffuse. Lustre index is thus defined as the ratio of the specular reflected light to the diffusely reflected light.

Lustre index of a particle of the invention is defined relative to a standard, for example of the light reflecting component, prior to application or the particle, or relative to a chosen standard reflecting component such as mica.

For example, a particle of the invention comprising a specular visible light reflecting component containing mica is compared with a sample of the mica not contained in the particle of the invention. For example a suitable standard sample is the commercially available Iriodin 183 mica-based reflecting material (available form Merck), but also other mica based materials are suitable.

The standard and the product can then be measured by, for example, placing the mica standard and the particle containing the reflecting component comprising the mica, in two separate, identical beakers and directing the visible light on the two samples in the two beakers, and measuring for each the light reflection under the given angle.

The lustre index can then be calculated with the formula:

$$\frac{\frac{L_{22.5,b}}{L_{22.5,s}} - \frac{L_{45,b}}{L_{0,s}}}{\frac{L_{22.5,b}}{L_{22.5,s}}} \times 100$$

wherein L is the standard CIElab definition of whiteness intensity; 0, 22.5 and 45 are the viewing angles in degrees for the goniophotometer, 'b' refers to the L value of the product sample (e.g. the particle of the invention) for measurement and 's' is the L value of reference standard. Hence by this definition $L_{22.5,b}$ is the whiteness intensity of the product sample measured at 22.5°. Similarly, $L_{0,s}$ is the whiteness intensity of the standard measured at 0°.

The lustre index of for example a detergent particle of the invention comprising a reflecting component comprising mica, is preferably from 3 to 100, preferably from 5 to 100, or even from to 10 to 100, as measured by the method above.

Preferably, when another reflecting component is used in the particle, composition, tablet or bar, the specular visible light reflection thereof is of the same intensity as that of the particle, composition, tablet or bar, of the same composition but comprising instead a reflecting component containing mica, which has a lustre index of 3 to 100, preferably 5 to 100 or even 10 to 1000, as described above.

In a preferred embodiment the specular visible light reflection of the particle of the invention, or of the detergent composition, bar or tablet of the invention is of higher intensity than the specular visible light reflection of sodium citrate salt sample having 100% by weight of particle between the particle size 355 and 600 and a mean particle size of 450 microns, as measured by use of sieving on American Standard wire sieves (ASTME 11:81), such that 100% of the particles is on sieve 42 and 100% is through sieve 28.

Then, the particle, composition, tablet or bar of the invention preferably has a higher lustre index, compared to a mica standard as set out above, than the lustre index of said sodium citrate compared to the same mica standard.

Preferably, the pigment component comprises a sheet layer material. Highly preferred is that the pigment component comprises BiOCl or even more preferably mica, or mixtures thereof. Preferred is mica as available from Merck under the name Iriodin. Iriodin 100–299 is a range of such mica-containing reflecting components for use herein, whereby 183, 221, 223, 231 and 289 are examples of specific pigments within this range which are particularly suitable.

The light reflecting component preferably comprises also a metal oxide, such as $TiO_2$ or $Fe_2O_3$. The metal oxide is preferably applied onto the light reflecting component or the particle as a coating. Highly preferred light reflecting component herein comprises mica and $TiO_2$.

It may be preferred that the visible light reflecting component comprises water soluble or water-dispersable material. For example, where the material comprises water-dispersable material, the particle size of the component will be such that at least 90% by weight, preferably at least 95% by weight or even 99% by weight is below 100 microns or even 75 microns, preferably from 5 microns to 50 microns.

In one embodiment, the particle comprises one or more detergent ingredients commonly employed in detergent compositions, as also described herein after, which are in particulate form. Then, the light reflecting component is preferably applied onto the surface of the detergent particle or part of the surface. Preferably, the light reflecting component is applied evenly or homogeneously over the surface of the particle.

The reflecting detergent particle can for example comprise a particulate inorganic or organic salt or acid, such as a carbonate salt, sulphate salt, phosphate salt, carboxylic acid or salt thereof. Hereby, it may be preferred that the salt or acid is in crystalline form.

Highly preferred are citric acid or sodium citrate crystalline particles comprising the light reflecting component.

Alternatively, the reflecting detergent particle may be comprise one or more detergent actives, which are preferably selected from surfactants, builders, bleaching agents, enzymes, suds suppressors, softening agents or mixtures thereof. In a preferred embodiment the light reflecting component is applied to a detergent base granule, for example an agglomerate or spray dried or extruded detergent particle comprising one or more of the detergent ingredients mentioned herein. It may be preferred that the light reflecting component is applied to only those detergent particles which have an undesired colour, but it may also be preferred that the light reflecting component is applied to the detergent composition as a whole, comprising several particulate detergent component.

Highly preferred may be that the particulate component is a base granule formed by agglomerating or extruding a number of particulate components, such as blown powder particles, bleach activator particles, enzyme particles, perfume particles, softening components, sudsuppressor particles etc, preferably by using a binder (PEG, water, nonionic surfactants are preferred), and that this base granule comprises the light reflecting component on its surface.

In another embodiment the particle consist essentially of the light reflecting component. Then, the light reflecting component is added or dry-mixed to the other detergent ingredients in particulate form. Thus, for example in a preferred embodiment particles consisting essentially of mica are added as reflecting particles to the detergent composition, to provide the required masking or contrasting.

In another embodiment of the invention the light reflecting component is applied to the surface of a detergent tablet or detergent bar, or part of the surface thereof. Preferably, the light reflecting component is applied such that it forms a homogeneous or even layer on the tablet or bar. For example, the tablet may comprise a conventional coating agent which comprises also the light reflecting component.

In addition to the light reflecting component on the surface of the tablet or bar, the tablet or bar may also comprise in its core additional light reflecting component, either in the form of detergent particles containing the light reflecting component and/or as particles consisting of the light reflecting component.

The particle size of the reflecting particle can be any particle size, for example depending on the composition and the application of the particle or the characteristics and application of the detergent composition comprising it.

The mean particle size of the light reflecting component will depend on which light reflecting component is used and on its application. For example, when the light reflecting component in applied to the surface of a detergent particle, the mean particle size of the light reflecting component is preferably less than the mean particle size of the detergent particle, whilst when the reflecting particle consist essentially of the light reflecting component, the mean particle size of the particle is not restricted by the mean particle size of the other detergent particles. For example, when the light reflecting component contains mica, it may be preferred that the mean particle size is around 600 microns or less, because it has been found that larger particle size sheet layer mica material can be too fragile and thus more difficult to handle.

The preferred mean particle size of the light reflecting component is preferably from 0.05 micron to 1500 micron, more preferably from 0.1 micron to 1000 micron, but more preferably from 0.5 to 500 micron, or even from 3 micron to 200 micron or most preferably from 5 micron to 50 micron, preferably 90% or even 95% or even 99% by weight of the component being from 5 to 100 or even to 50 microns, as described above.

Preferably, when the reflecting particle herein comprises one or more detergent ingredients, the light reflecting component is present at a level of from 0.001% to 15% by weight, more preferably from 0.01% to 7% by weight or even more preferably from 0.05% to 5% by weight of the particle.

When the particle consist essentially of the light reflecting component the particle is preferably present in the composition at a level of from 0.01% to 10%, more preferably from 0.05% to 5% or even form 0.01% to 3% by weight of the composition.

When the particle comprises one or more other detergent ingredients, the particle can be made by a number of methods, including by any methods commonly used to apply coating materials on detergent particles or to mix detergent ingredients.

A highly preferred method of the invention comprises the steps of a) obtaining a particulate material which comprises the particulate component or components including a binding material;

b) dusting the particulate material of step a) with the light reflecting component;

c) optionally applying additional binding material onto the particle of step b).

The binding material may be part of the component or components or may be specifically added to the component or components to provide the adhesion of the reflecting component. For example, the detergent component can be a detergent base granule comprising nonionic surfactant, capable of providing adhesion of the light reflecting component, in which case no additional binding material may be needed.

Preferred is that the fight reflecting component becomes hereby evenly or homogeneously applied an the surface of the particle detergent particle.

Preferably, in step a) a binder material is applied on the detergent particle, for example by spraying the binder material onto the particle.

Alternatively, or in addition thereto, the detergent particle may comprise already one or more ingredients which provides the binding of the light reflecting component, for example, the detergent particle may comprise a viscous ingredient such as a nonionic surfactant, which provides an adhesive effect for the light reflecting component. Then, the light reflecting component may even help to reduces the stickiness of the particle comprising the binder material, which may result in a better flowability of the particles and may even reduce or eliminate the need for other process aids normally used to improve the flowability of detergent particles, such as dusting with fine powdered material (aluminosilicates for example).

Another process for making the reflecting particle herein comprising the step of applying onto a particulate detergent material, as described above, a mixture of the light reflecting component and a binding material. Any conventional coating process may be used therefor.

Yet another preferred process involves the step of wetting a particulate component, for example with water or of a solution of other ingredients such as dyes in water, and then applying the reflecting component to the particulate component, optionally followed by drying the thus obtained particle. This may be in particular preferred when organic or inorganic salts or acids are coated with a reflecting component. Alternatively, the reflecting component can be dispersed or dissolved in a solvent, such as water, and then applied on a particulate component, optionally followed by drying of the thus obtained particle.

The light reflecting component may also be mixed with the other detergent ingredients by any conventional granulation method, such as agglomeration, spray drying or extrusion, to form the reflecting particle. However, this is a less preferred method, because only part of the light reflecting component will then be present on the surface of the particle. This is thus a less effective way of provide reflection by the particles.

These processes can equally be use to apply the light reflecting component onto a detergent tablet of bar, preferably evenly or homogeneously over the surface of the tablet, or even in the form of a coating.

The binder may be any compound capable of providing adhesion of the light reflecting component to the particle, or the tablet or bar. Preferably the binder material is a component which is viscous or can be made into a viscous or liquid form by melting, or dissolution at the processing temperature. For example, water can be used to make a solution or dispersion of the reflecting component.

Preferably, the binder material is a detergent ingredient which has an additional function in the composition, in addition to binding the light reflecting component. Therefore, preferred binding materials are dye transfer inhibiting polymers, soil releasing polymers, flocculating or deflocculating agents, polymeric builders, such as polymeric polycarboxylates or polymeric polycarboxylic acids, which are described herein after in more detail.

Highly preferred are binding materials comprising a nonionic surfactant, in particulate alkoxylated (preferably ethoxylated) nonionic surfactants, but also wax and oils, and more preferably polyalkylene glycols, most preferably polyethylene glycol, preferably having a average molecular weight of from 500 to 40,00, or even from 2000 to 20,000 or even from 4000 to 10,000.

It may be highly preferred that the reflecting particle herein also comprises a colorant. The colorant may then be applied by any known method for dyeing detergent particles. For example, the colorant may be mixed with the light reflecting component and preferably a binder material and then applied onto the particle or tablet or bar. Alternatively, it may be preferred that the colorant is applied to the particle comprising or consisting of the light reflecting component, for example by spraying the colorant onto the particle with the light reflecting component. Alternatively, if the particle comprises one or more detergent ingredients, the colorant can be applied to the particle prior to application of the light reflecting component.

Highly preferred may be a reflecting particle comprising an organic or inorganic salt or acid comprising a colorant and a light reflecting component, preferably a crystalline material such sodium citrate comprising preferably a blue or green dye and preferably mica, optionally also comprising $TiO_2$.

The colorant or dye used for dyeing the particles as used herein can be a dye stuff or an aqueous solution of a dye stuff or an non-aqueous solution of or mixture with a dye stuff, for example using a carrier material such as a nonionic surfactant or other binder material. The use of an non-aqueous solution may have as an advantage herein that no subsequent drying step is needed when the solution is applied to the speckle particles. The dyestuff can be any suitable dyestuff. Specific examples of suitable dyestuffs include E104—food yellow 13 (quinoline yellow), E110—food yellow 3 (sunset yellow FCF), E131—food blue 5 (patent blue V), Ultra Marine blue (trade name), E133—food blue 2 (brilliant blue FCF), E140—natual green 3 (chlorophyll and chlorphyllins), E141 and Pigment green 7 (chlorinated Cu phthalocyanine). Preferred dyestuffs may be Monastral Blue BV paste (trade name) and/or Pigmasol Green (trade name).

The particle herein may be coloured with a brightener, preferably certain types of hydrophilic optical brighteners. The brightener species may be any material known in the art, preferably those which are commercially marketed under the tradename Tinopal by Ciba Geigy Corporation.

Compositions

The reflecting particle is preferably present in detergent compositions, preferably laundry or dish washing compositions, fabric conditioners, or hard surface cleaning compositions. In a preferred embodiment the compositions are solid, preferably in the form of a granules, flakes, extrudates, bars or tablets. The compositions are preferably solid detergents which have a density of at least 350 g/liter, more preferably at least 500 g/liter.

The precise level of reflecting particles present in the composition depends in particulate on the degree of light reflection the reflecting particle, the composition of the particle and the other ingredients of the composition, but also the particle size of the particles and the other ingredients of the composition, and the application of the composition.

The detergent composition, or the particle in one embodiment of the invention, may comprise any conventional ingredient, commonly employed in detergent compositions, preferred ingredients described herein after.

The reflecting particle of the invention is particularly useful in compositions comprising ingredients which do not have the desired product colour, or in compositions comprising hygroscopic ingredients which may absorb moisture and may cause any dye present, to bleed.

The compositions herein thus preferably comprising ingredients such as particles comprising surfactant, enzymes, bleach activators, cellulose derivative or mixtures thereof, which tend to have an undesired colour.

The surfactant containing reflecting particles are preferably agglomerates with anionic and/or nonionic surfactants, preferably with LAS and/or ethoxylated alcohol surfactants.

Also preferred are reflecting particles herein, containing peroxy acid bleach precursors, such as TAED, NAC-OBS, and other OBS-variants, or mixtures thereof.

The composition can be made by any method known in the art, including by agglomeration and/or spray-drying, whereby certain ingredients may be admixed or sprayed-on as described herein. It may optionally be preferred that the composition is made by mixing all or part of the granules, including those made by agglomeration or spray-drying and even the reflecting particle of the invention, and subsequently adding a binder and agglomerating the mixture and binder to form agglomerated detergent granules, which may be of the required particle size or which may be sieved to obtain particles of the required size.

It may be preferred that the composition comprises as builder system or as part of the builder system, an agglomerate particle, which may comprise the light reflecting component, comprising from 0.5% to 80% by weight a crystalline layered silicate, from 10% to 70% by weight of a surfactant, preferably an anionic surfactant and preferably less than 10% by weight of the agglomerate of free moisture, more preferably 30% to 60% by weight a crystalline layered silicate and 20% to 50% by weight of an anionic surfactant.

It may be highly preferred that the detergent composition comprises an effervescence component, preferably comprising an acid source and an alkali source capable of reacting together to form a gas upon contact with water, in particular a carbon dioxide gas, formed by reaction of an organic carboxylic acid and a carbonate source. It may be preferred that the effervescence component is a particulate component having an average particle size, by weight, of from 700 microns to 1400 microns, preferably from 750 microns to 1100 microns, preferably comprising an acid source and an alkali source.

It may be preferred that the effervescence component is substantially free of water, preferably such that no water has been intimately mixed with the effervescence component or part thereof, or that no water is present other than the moisture of the raw materials themselves. Typically, the level of water in intimate mixture with the effervescence component is below 5% by weight of the total granule, preferably below 3% and more preferably below 1.5%, preferably obtainable by dry-powder compaction or pressure agglomeration.

This component may be in the form of a particle, which may be a reflecting particle as described herein, comprising the light reflecting component.

Suitable acids to be used herein include solid organic, mineral or inorganic acids, salts or derivatives thereof or a mixture thereof. It may be preferred that the acids are mono-, bi- or tri-protonic acids. Such acids include mono- or polycarboxylic acids preferably citric acid, adipic acid, glutaric acid, 3 chetoglutaric acid, citramalic acid, tartaric acid, maleic acid, fumaric acid, malic acid, succinic acid, malonic acid. Such acids are preferably used in their acidic forms, and it may be preferred that their anhydrous forms are used, or mixtures thereof. Derivatives also include ester of the acids.

The effervescence component or source preferably carbonate, bicarbonate or/and percarbonate salts, in particular bicarbonate and/or carbonate. Suitable carbonates to be used herein include carbonate and hydrogen carbonate of potassium, lithium, sodium, and the like amongst which sodium and potassium carbonate are preferred. Suitable bicarbonates to be used herein include any alkali metal salt of bicarbonate like lithium, sodium, potassium and the like, amongst which sodium and potassium bicarbonate are preferred.

The effervescence component is preferably present in the composition according to the present invention at a level of from 0.5% to 60% by weight, preferably from 2% to 50%, more preferably from 5% to 45% and preferably such that the acid component is present at a level of from 0.3% to 40%, more preferably from 1.0% to 35%, or even 2% to 25% or even to 15% by weight of the composition.

Surfactant

The compositions or in one embodiment preferably the particle herein, preferably contain one or more surfactants selected from anionic, nonionic, cationic, ampholytic, amphoteric and zwitterionic surfactants and mixtures thereof.

A typical listing of anionic, nonionic, ampholytic, and zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). A list of suitable cationic surfactants is given in U.S. Pat. No. 4,259,217 issued to Murphy on Mar. 31, 1981.

Where present, ampholytic, amphoteric and zwitteronic surfactants are generally used in combination with one or more anionic and/or nonionic surfactants.

Anionic Surfactant

The compositions or in one embodiment preferably the particle preferably comprise an additional anionic surfactant. Essentially any anionic surfactants useful for detersive purposes can be comprised in the detergent composition. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate and sulfonate surfactants are preferred.

Highly preferred are surfactants systems comprising a sulfonate and a sulfate surfactant, preferably a linear or branched alkyl benzene sulfonate and alkyl ethoxylsulfates, as described herein, preferably combined with a cationic surfactants as described herein.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulfate Surfactant

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N—($C_1$–$C_4$ alkyl) and —N—($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl sulfate surfactants are preferably selected from the linear and branched primary $C_{10}$–$C_{18}$ alkyl sulfates, more preferably the $C_{11}$–$C_{15}$ branched chain alkyl sulfates and the $C_{12}$–$C_{14}$ linear chain alkyl sulfates.

Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

A particularly preferred aspect of the invention employs mixtures of the preferred alkyl sulfate and or sulfonate and alkyl ethoxysulfate surfactants. Such mixtures have been disclosed in PCT Patent Application No. WO 93/18124.

Anionic Sulfonate Surfactant

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy caaboxylates include those with the formula $RO(CH_2CH_2O)_x\ CH_2COO^-M^+$ wherein R is a $C_6$ to $C_{18}$ alkyl group, x ranges from O to 10, and the ethoxylate distribution is such that, on a weight basis, the amount of material where x is 0 is less than 20% and M is a cation. Suitable alkyl polyethoxy polycarboxylate surfactants include those having the formula RO—($CHR_1$—$CHR_2$—O)—$R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl -1-octanoic acid and 2-pentyl-1-heptanoic acid. Certain soaps may also be included as suds suppressors.

Alkali Metal Sarcosinate Surfactant

Other suitable anionic surfactants are the alkali metal sarcosinates of formula R—CON ($R^1$) $CH_2$ COOM, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleoyl methyl sarcosinates in the form of their sodium salts.

Alkoxylated Nonionic Surfactant

Essentially any alkoxylated nonionic surfactants are suitable herein. The nonionic surfactants are in particularly also useful as binding material or part thereof to apply the light reflecting component to the particle or tablet or bars herein, as described above. The ethoxylated and propoxylated nonionic surfactants are preferred.

Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

Nonionic Alkoxylated Alcohol Surfactant

The condensation products of aliphatic alcohols with from 1 to 25 moles of alcylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Nonionic Polyhydroxy Fatty Acid Amide Surfactant

Polyhydroxy fatty acid amides suitable for use herein are those having the structural formula $R^2CONR^1Z$ wherein: R1 is H, $Ch_1$–$C_4$ hydrocarbyl, 2-hydroxy ethyl, 2-hydroxy propyl, ethoxy, propoxy, or a mixture thereof, preferable C1–C4 alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydoxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

Nonioinic Fatty Acid Amide Surfactant

Suitable fatty acid amide suractants include those having the formula: $R^6CON(R^7)_2$ wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and —$(C_2H_4O)_xH$, where x is in the range of from 1 to 3.

Nonionic Alkylpolysaccharide Surfactant

Suitable alkylpolysaccharides for use herein are disclosed in U.S. Pat. No. 4,565,647, Llenado, issued Jan. 21, 1986, having a hydrophobic group containing from 6 to 30 carbon atoms and a polysaccharide, e.g., a polyglycoside, hydrophilic group containing from 1.3 to 10 saccharide units.

Preferred alkylpolyglycosides have the formula:

$$R^2O(C_nH_{2n}O)t(\text{glycosyl})_x$$

wherein $R^2$ is selected from the group consisting of alkyl alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Amphoteric Surfactant

Suitable amphoteric surfactants for use herein include the amine oxide surfactants and the alkyl amphocarboxylic acids.

Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10}$–$C_{18}$ acylamido alkyl dimethylamine oxide.

A suitable example of an alkyl aphodicarboxylic acid is Miranol(TM) C2M Conc. manufactured by Miranol, Inc., Dayton, N.J.

Zwitterionic Surfactant

Zwitterionic surfactants can also be incorporated into the detergent compositions in accord with the invention. These surfactants can be broadly described as derivatives of secondary and tertiary amines, derivatives of heterocyclic secondary and tertiary amines, or derivatives of quaternary ammonium, quaterary phosphonium or tertiary sulfonium compounds. Betaine and sultaine surfactants are exemplary zwitterionic surfactants for use herein.

Suitable betaines are those compounds having the formula $R(R')_2N^+R^2COO$— wherein R is a $C_6$–$C_{18}$ hydrocarbyl group, each $R^1$ is typically $C_1$–$C_3$ alkyl, and $R^2$ is a $C_1$–$C_5$ hydrocarbyl group. Preferred betaines are $C_{12\text{-}18}$ dimethylammnonio hexanoate and the $C_{10\text{-}18}$ acylamidopropane (or ethane) dimethyl (or diethyl) betaines. Complex betaine surfactants are also suitable for use herein.

Cationic Surfactants

Suitable cationic surfactants to be used in the detergent herein or in one embodiment preferably the particle include the quaternary ammonium surfactants. Preferably the quaternary ammonium surfactant is a mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups. Preferred are also the mono-alkoxylated and bis-alkoxylated amine surfactants.

Another suitable group of cationic surfactants which can be used in the detergent compositions or components thereof herein are cationic ester surfactants. The cationic ester surfactant is a, preferably water dispersible, compound having surfactant properties comprising at least one ester (i.e. —COO—) linkage and at least one cationically charged group.

Suitable cationic ester surfactants, including choline ester surfactants, have for example been disclosed in U.S. Pat. Nos. 4,228,042, 4,239,660 and 4,260,529.

In one preferred aspect the ester linkage and cationically charged group are separated from each other in the surfactant molecule by a spacer group consisting of a chain comprising at least three atoms (i.e. of three atoms chain length), preferably from three to eight atoms, more preferably from three to five atoms, most preferably three atoms. The atoms forming the spacer group chain are selected from the group consisting of carbon, nitrogen and oxygen atoms and any mixtures thereof, with the proviso that any nitrogen or oxygen atom in said chain connects only with carbon atoms in the chain. Thus spacer groups having, for example, —O—O—(i.e. peroxide), —N—N—, and —N—O— linkages are excluded, whilst spacer groups having, for example —$CH_2$—O—$CH_2$— and —$CH_2$—NH—$CH_2$— linkages are included. In a preferred aspect the spacer group chain comprises only carbon atoms, most preferably the chain is a hydrocarbyl chain.

Cationic mono-alkoxylated Amine Surfactants

Highly preferred herein are cationic mono-alkoxylated amine surfactant preferably of the general formula I:

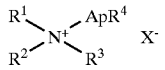

(I)

wherein $R^1$ is an alkyl or alkenyl moiety containing from about 6 to about 18 carbon atoms, preferably 6 to about 16 carbon atoms, most preferably from about 6 to about 14 carbon atoms; $R^2$ and $R^3$ are each independently alkyl groups containing from one to about three carbon atoms, preferably methyl, most preferably both $R^2$ and $R^3$ are methyl groups; $R^4$ is selected from hydrogen (preferred), methyl and ethyl; $X^-$ is an anion such as chloride, bromide, methylsulfate, sulfate, or the like, to provide electrical neutality; A is a alkoxy group, especially a ethoxy, propoxy or butoxy group; and p is from 0 to about 30, preferably 2 to about 15, most preferably 2 to about 8.

Preferably the $ApR^4$ group in formula I has p=1 and is a hydroxyalkyl group, having no greater than 6 carbon atoms whereby the —OH group is separated from the quaternary ammonium nitrogen atom by no more than 3 carbon atoms. Particularly preferred $ApR^4$ groups are —$CH_2CH_2OH$, —$CH_2CH_2CH_2OH$, —$CH_2CH(CH_3)OH$ and —$CH(CH_3)CH_2OH$, with —$CH_2CH_2OH$ being particularly preferred. Preferred $R^1$ groups are linear alkyl groups. Linear $R^1$ groups having from 8 to 14 carbon atoms are preferred.

Another highly preferred cationic mono-alkoxylated amine surfactants for use herein are of the formula

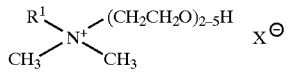

wherein $R^1$ is $C_{10}$–$C_{18}$ hydrocarbyl and mixtures thereof, especially $C_{10}$–$C_{14}$ alkyl, preferably $C_{10}$ and $C_{12}$ alkyl, and X is any convenient anion to provide charge balance, preferably chloride or bromide.

As noted, compounds of the foregoing type include those wherein the ethoxy ($CH_2CH_2O$) units (EO) are replaced by butoxy, isopropoxy [$CH(CH_3)CH_2O$] and [$CH_2CH(CH_3O$] units (i-Pr) or n-propoxy units (Pr), or mixtures of EO and/or Pr and/or i-Pr units.

The levels of the cationic mono-alkoxylated amine surfactants used in detergent compositions of the invention is preferably from 0.1% to 20%, more preferably from 0.2% to 7%, most preferably from 0.3% to 3.0% by weight of the composition.

Cationic Bis-alkoxylated Amine Surfactant

The cationic bis-alkoxylated amine surfactant preferably has the general formula II:

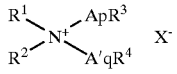

(II)

wherein $R^1$ is an alkyl or alkenyl moiety containing from about 8 to about 18 carbon atoms, preferably 10 to about 16 carbon atoms, most preferably from about 10 to about 14 carbon atoms; $R^2$ is an alkyl group containing from one to three carbon atoms, preferably methyl; $R^3$ and $R^4$ can vary independently and are selected from hydrogen (preferred), methyl and ethyl, $X^-$ is an anion such as chloride, bromide, methylsulfate, sulfate, or the like, sufficient to provide electrical neutrality. A and A' can vary independently and are each selected from $C_1$–$C_4$ alkoxy, especially ethoxy, (i.e., —$CH_2CH_2O$—), propoxy, butoxy and mixtures thereof; p is from 1 to about 30, preferably 1 to about 4 and q is from 1 to about 30, preferably 1 to about 4, and most preferably both p and q are 1.

Highly preferred cationic bis-alkoxylated amine surfactants for use herein are of the formula

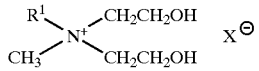

wherein $R^1$ is $C_{10}$–$C_{18}$ hydrocarbyl and mixtures thereof preferably $C_{10}$, $C_{12}$, $C_{14}$ alkyl and mixtures thereof. X is any convenient anion to provide charge balance, preferably chloride. With reference to the general cationic bis-alkoxylated amine structure noted above, since in a preferred compound $R^1$ is derived from (coconut) $C_{12}$–$C_{14}$ alkyl fraction fatty acids, $R^2$ is methyl and $ApR^3$ and $A'qR^4$ are each monoethoxy.

Other cationic bis-alkoxylated amine surfactants useful herein include compounds of the formula:

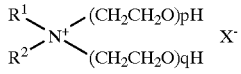

wherein $R^1$ is $C_{10}$–$C_{18}$ hydrocarbyl, preferably $C_{10}$–$C_{14}$ alkyl, independently p is 1 to about 3 and q is 1 to about 3, $R^2$ is $C_1$–$C_3$ alkyl, preferably methyl, and X is an anion, especially chloride or bromide.

Other compounds of the foregoing type include those wherein the ethoxy ($CH_2CH_2O$) units (EO) are replaced by butoxy (Bu) isopropoxy [$CH(CH_3)CH_2O$] and [$CH_2CH(CH_3O$] units (i-Pr) or n-propoxy units (Pr), or mixtures of EO and/or Pr and/or i-Pr units.

Perhydrate Bleaches

An preferred additional components of the compositions or in one embodiment preferably the particle herein, is a perhydrate bleach, such as metal perborates, metal percarbonates, particularly the sodium salts. Perborate can be mono or tetra hydrated. Sodium percarbonate has the formula corresponding to $2Na_2CO_3.3H_2O_2$, and is available commercially as a crystalline solid.

The perhydrate bleach may be coated, for example with sulphate salts or carbonate salts or silicate or mixtures thereof.

Potassium peroxymonopersulfate, sodium per is another optional inorganic perhydrate salt of use in the detergent compositions herein.

Bleach Activator

The composition or in one embodiment the particle herein, preferably comprises a bleach activator, preferably comprising an organic peroxyacid bleach precursor. It may be preferred that the composition comprises at least two peroxy acid bleach precursors, preferably at least one hydrophobic peroxyacid bleach precursor and at least one hydrophilic peroxy acid bleach precursor, as defined herein.

The bleach activator may also comprise a preformed peroxy acid bleach.

The production of the organic peroxyacid occurs by an in situ reaction of the precursor with a source of hydrogen peroxide.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as

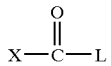

where L is a leaving group and X is essentially any functionality, such that on perhydroloysis the structure of the peroxyacid produced is

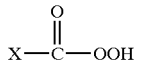

For the purpose of the invention, hydrophobic peroxyacid bleach precursors produce a peroxy acid of the formula above wherein X is a group comprising at least 6 carbon atoms and a hydrophilic peroxyacid bleach precursor produces a peroxyacid bleach of the formula above wherein X is a group comprising 1 to 5 carbon atoms.

Peroxyacid bleach precursor compounds are preferably incorporated at a level of from 0.5% to 20% by weight, more preferably from 1% to 15% by weight, most preferably from 1.5% to 10% by weight of the detergent compositions.

Suitable peroxyacid bleach precursor compounds typically contain one or more N— or O— acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilize for use in a bleaching composition.

Preferred L groups are selected from the group consisting of:

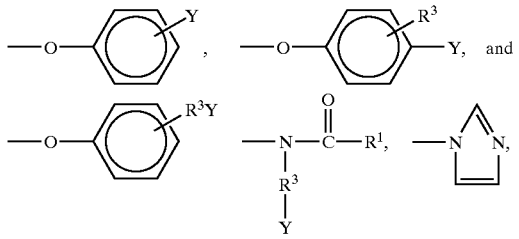

-continued

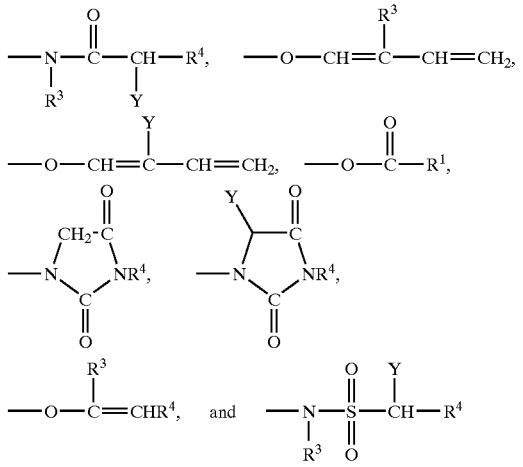

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammonium groups.

The preferred solubilizing groups are $—SO_3^-M^+$, $—CO_2^-M^+$, $—SO_4^-M^+$, $—N^+(R^3)_4X^-$ and $O<—N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the N—,N,$N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred as hydrophilic peroxy acid bleach precursor.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose.

Amide Substituted Plkyl Peroxyacid Precursors

Amide substituted alkyl peroxyacid precursor compounds are suitable herein, including those of the following general formulae:

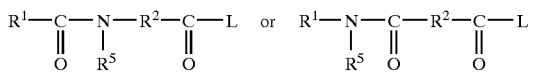

wherein $R^1$ is an aryl or alkaryl group with from about 1 to about 14 carbon atoms, $R^2$ is an alkylene, arylene, and alkarylene group containing from about 1 to 14 carbon atoms, and $R^5$ is H or an alkyl, aryl, or alkaryl group containing 1 to 10 carbon atoms and L can be essentially any leaving group. $R^1$ preferably contains from about 6 to 12 carbon atoms. $R^2$ preferably contains from about 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$, $R^2$ can include alkyl, aryl, wherein said $R^2$ may also contain halogen, nitrogen, sulphur and other typical substituent groups or organic compounds. $R^5$ is preferably H or methyl. $R^1$ and $R^5$ should not contain more than 18 carbon atoms total. Amide substituted bleach activator compounds of this type are described in EP-A0170386. It can be preferred that $R^1$ and $R^5$ forms together with the nitrogen and carbon atom a ring structure.

Preferred examples of bleach precursors of this type include amide substituted peroxyacid precursor compounds selected from (6octanamido-caproyl)oxybenzenesulfonate, (6-decanamido-caproyl) oxybenzene-sulfonate, and the highly preferred (6-nonanamidocaproyl)oxy benzene sulfonate, and mixtures thereof as described in EP-A -0170386.

Perbenzoic Acid Precursor

Perbenzoic acid precursor compounds provide perbenzoic acid on perhydrolysis. Suitable O-acylated perbenzoic acid precursor compounds include the substituted and unsubstituted benzoyl oxybenzene sulfonates, and the benzoylation products of sorbitol, glucose, and all saccharides with benzoylatig agents, and those of the imide type including N-benzoyl succinimide, tetrabenzoyl ethylene diamine and the N-benzoyl substituted ureas. Suitable imidazole type perbennoic acid precursors include N-benzoyl imidazole and N-benzoyl benzimidazole. Other useful N-acyl group-containing perbenzoic acid precursors include N-benzoyl pyrrolidone, dibenzoyl taurine and benzoyl pyroglutamic acid.

Preformed Organic Peroxyacid

The detergent composition may contain, in addition to, or as an alternative to, an organic peroxyacid bleach precursor compound, a preformed organic peroxyacid, typically at a level of from 1% to 15% by weight, more preferably from 1% to 10% by weight of the composition.

A preferred class of organic peroxyacid compounds are the amide substituted compounds of the following general formulae:

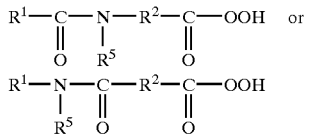

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. Amide substituted organic peroxyacid compounds of this type are described in EP-A-0170386.

Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

Heavy Metal Ion Sequestrant

The compositions of the invention or in one embodiment the particle herein preferably contain as an optional component a heavy metal ion sequestrant or chelant or chelating agent. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 10%, preferably from 0.1% to 5%, more preferably from 0.25% to 7.5% and most preferably from 0.3% to 2% by weight of the compositions or component Suitable heavy metal ion sequestrants for use herein include organic phosphonates, such the amino alkylene poly (alkylene phosphonates), alkali metal ethane 1-hydroxy disphosphonates and nitrilo trimethylene phosphonates.

Preferred among the above species are diethylene triamine penta (methylene phosphonate), ethylene diamine tri (methylene phosphonate)hexamethylene diamine tetra (methylene phosphonate) and hydroxy-ethylene 1,1 diphosphonate, 1,1 hydroxyethane diphosphonic acid and 1,1 hydroxyethane dimethylene phosphonic acid.

Other suitable heavy metal ion sequestrant for use herein include nitrilotriacetic acid and polyaminocarboxylic acids such as ethylenediaminotetracetic acid, ethylenediamine disuccinic acid, ethylenediamine diglutaric acid, 2-hydroxypropylenediarnine disuccinic acid or any salts thereof.

Other suitable heavy metal ion sequestrants for use herein are iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The β-alanine-N,N'-diacetic acid, aspartic acid-N,N'-diacetic acid, aspartic acid-N-monoacetic acid and iminodisuccinic acid sequestrants described in EP-A-509,382 are also suitable.

EP-A476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are alos suitable. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable.

Especially preferred are diethylenetriamine pentacetic acid, ethylenediamine-N,N'-disuccinic acid (EDDS) and 1,1 hydroxyethane diphosphonic acid or the alkali metal, alkaline earth metal, ammonium, or substituted ammonium salts thereof, or mixtures thereof In particular the chelating agents comprising a amino or amine group can be bleach-sensitive and are suitable in the compositions of the invention.

Enzyme

Another highly preferred ingredient useful in the compositions herein or in one embodiment the particle herein is one or more enzymes.

Preferred additional enzymatic materials include the commercially available lipases, cutinases, amylases, neutral and alkaline proteases, cellulases, endolases, esterases, pectinases, lactases and peroxidases conventionally incorporated into detergent compositions. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, α-amylases obtained from a special strain of B licheniformis, described in more detail in GB-1,269,839 (Novo). Preferred commercially available amylases include for example, those sold under the tradename Rapidase by Gist-Brocades, and those sold under the tradename Termamyl, Duramyl and BAN by Novo Industries A/S. Highly preferred amylase enzymes maybe those described in PCT/US 9703635, and in WO95/26397 and WO96/23873.

Amylase enzyme may be incorporated into the composition in accordance with the invention at a level of from 0.0001% to 2% active enzyme by weight of the composition.

Lipolytic enzyme may be present at levels of active lipolytic enzyme of from 0.0001% to 2% by weight, preferably 0.001% to 1% by weight, most preferably from 0.001% to 0.5% by weight of the compositions.

The lipase may be fungal or bacterial in origin being obtained, for example, from a lipase producing strain of Humicola sp., Thermomyces sp. or Pseudomonas sp. including *Pseudomonas pseudoalcaligenes* or *Pseudomas fluorescens*. Lipase from chemically or genetically modified mutants of these strains are also useful herein. A preferred lipase is derived from *Pseudomonas pseudoalcaligenes*, which is described in Granted European Patent, EP-B-0218272.

Another preferred lipase herein is obtained by cloning the gene from *Humicola lanuginosa* and expressing the gene in *Aspergillus oryza* as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Optical Brightener

The compositions herein or in one embodiment the particle herein may optionally contain from about 0.005% to 5% by weight of certain types of hydrophilic optical brighteners, as mentioned above.

Photo-bleaching Agent

Photo-bleaching agents are preferred ingredients of the compositions herein. Preferred photo-bleaching agent herein comprise a compounds having a porphin or porphyrin structure.

Porphin and porphyrin, in the literature, are used as synonyms, but conventionally porphin stands for the simplest porphyrin without any substituents; wherein porphyrin is a sub-class of porphin. The references to porphin in this application will include porphyrin.

The porphin structures preferably comprise a metal element or cation, preferably Ca, Mg, P, Ti, Cr, Zr, In, Sn or Hf, more preferably Ge, Si or Ga, or more preferably Al, most preferably Zn.

It can be preferred that the photo-bleaching compound or component is substituted with substituents selected from alkyl groups such as methyl, ethyl, propyl, t-butyl group and aromatic ring systems such as pyridyl, pyridyl-N-oxide, phenyl, naphthyl and anthracyl moieties.

The photo-bleaching compound or component can have solubilizing groups as substituents. Alternatively, or in addition hereto the photo-bleaching agent can comprise a polymeric component capable of solubilizing the photo-bleaching compound, for example PVP, PVNP, PVI or co-polymers thereof or mixtures thereof.

Highly preferred photo-bleaching compounds are compounds having a phthalocyanine structure, which preferably have the metal elements or cations described above.

Metal phthalocyanines and their derivatives have the structure indicated in FIG. 1 and/or FIG. 2, wherein the atom positions of the phthalocyanine structure are numbered conventionally.

The phthalocyanines can be substituted for example the phthalocyanine structures which are substituted at one or more of the 1–4, 6, 8–11, 13, 15–18, 20, 22–25, 27 atom positions.

Water-Soluble Builder Compound

The compositions in accord with the present invention or in one embodiment the particle herein preferably contain a water-soluble builder compound, typically present in detergent compositions at a level of from 1% to 80% by weight, preferably from 10% to 60% by weight, most preferably from 15% to 40% by weight of the composition The detergent compositions of the invention preferably comprise phosphate-containing builder material. Preferably present at a level of from 0.5% to 60%, more preferably from 5% to 50%, more preferably from 8% to 40.

The phosphate-containing builder material preferably comprises tetrasodium pyrophosphate or even more preferably anhydrous sodium tripolyphosphate.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, and mixtures of any of the foregoing.

The carboxylate or polycarboxylate builder can be monomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid,tartaric acid, tartronic acid and fumaric acid, as well as the ether carboxylates and the sulfinyl carboxylates. Polycarboxylates or their acids containing three carboxy groups include, in particular, water-soluble citrates, aconitrates and citraconates as well as succinate derivatives such as the carboxymethyloxy succinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447. The most preferred polycarboxylic acid containing three carboxy groups is citric acid, preferably present at a level of from 0.1% to 15%, more preferably from 0.5% to 8% by weight of the composition.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No.

1,439,000. Preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing borate-forming materials that can produce borate under detergent storage or wash conditions are useful water-soluble builders herein.

Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Partially Soluble or Insoluble Builder Compound

The compositions in accord with the present invention or in one embodiment the particle herein may contain a partially soluble or insoluble builder compound, typically present in detergent compositions at a level of from 0.5% to 60% by weight, preferably from 5% to 50% by weight, most preferably from 8% to 40% weight of the composition.

Examples of largely water insoluble builders include the sodium aluminosilicates. As mentioned above, it may be preferred in one mbodiment of the inevntion, that only small amounts of alumino silicate builder are present.

Suitable aluminosilicate zeolites have the unit cell formula $Na_z[(AlO_2)_z(SiO_2)y]. xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof. Zeolite A has the formula:

$$Na_{12}[AlO_2)_{12}(SiO_2)_{12}]. xH_2O$$

wherein x is from 20 to 30, especially 27. Zeolite X has the formula $Na_{86}[(AlO_2)_{86}(SiO_2)_{106}].276H_2O$.

Another preferred aluminosilicate zeolite is zeolite MAP builder. The zeolite MAP can be present at a level of from 1% to 80%, more preferably from 15% to 40% by weight of the compositions.

Zeolite MAP is described in EP 384070A (Unilever). It is defined as an alkali metal alumino-silicate of the zeolite P type having a silicon to aluminium ratio not greater than 1.33, preferably within the range from 0.9 to 1.33 and more preferably within the range of from 0.9 to 1.2.

Of particular interest is zeolite MAP having a silicon to aluminium ratio not greater than 1.15 and, more particularly, not greater than 1.07.

In a preferred aspect the zeolite MAP detergent builder has a particle size, expressed as a $d_{50}$ value of from 1.0 to 10.0 micrometers, more preferably from 2.0 to 7.0 micrometers, most preferably from 2.5 to 5.0 micrometers.

The $d_{50}$ value indicates that 50% by weight of the particles have a diameter smaller than that figure. The particle size may, in particular be determined by conventional analytical techniques such as microscopic determination using a scanning electron microscope or by means of a laser granulometer. Other methods of establishing $d_{50}$ values are disclosed in EP 384070A.

Organic Polymeric Compound

Organic polymeric compounds are preferred additional components of the compositions herein or in one embodiment the particle herein, and they may also be present as or in the binder material to bind the light reflecting component as described above, and they are preferably present as components of any particulate components where they may act such as to bind the particulate component together. By organic polymeric compound it is meant herein essentially any polymeric organic compound commonly used as dispersants, and anti-redeposition and soil suspension agents in detergent compositions, including any of the high molecular weight organic polymeric compounds described as clay flocculating agents herein, including quaternised ethoxylated (poly) amine clay-soil removal/anti-redeposition agent in accord with the invention.

Organic polymeric compound is typically incorporated in the detergent compositions of the invention at a level of from 0.01% to 30%, preferably from 0.1% to 15%, most preferably from 0.5% to 10% by weight of the compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 1000–5000 and their copolymers with maleic anhydride, such copolymers having a molecular weight of from 2000 to 100,000, especially 40,000 to 80,000.

The polyamino compounds are useful herein including those derived from aspartic acid such as those disclosed in EP-A-305282, EP-A-305283 and EP-A-351629.

Terpolymers containing monomer units selected from maleic acid, acrylic acid, polyaspartic acid and vinyl alcohol, particularly those having an average molecular weight of from 5,000 to 10,000, are also suitable herein.

Other organic polymeric compounds suitable for incorporation in the detergent compositions herein include cellulose derivatives such as methylcellulose, carboxymethylcellulose, hydroxypropylmethylcellulose and hydroxyethylcellulose.

Further useful organic polymeric compounds are the polyethylene glycols, particularly those of molecular weight 1000–10000, more particularly 2000 to 8000 and most preferably about 4000.

Highly preferred polymeric components herein are cotton and non-cotton soil release polymer according to U.S. Pat. No. 4,968,451, Scheibel et al., and U.S. Pat. No. 5,415,807, Gosselink et al., and in particular according to U.S. application Ser. No. 60/051517.

Another organic compound, which is a preferred clay dispersant/anti-redeposition agent, for use herein, can be the ethoxylated cationic monoamines and diamines of the formula:

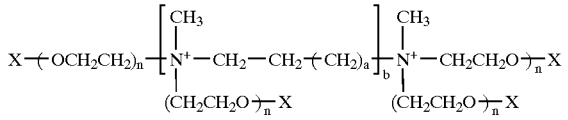

wherein X is a nonionic group selected from the group consisting of H, $C_1$–$C_4$ alkyl or hydroxyalkyl ester or ether groups, and mixtures thereof, a is from 0 to 20, preferably from 0 to 4 (e.g. ethylene, propylene, hexamethylene) b is 1 or 0; for cationic monoamines (b=0), n is at least 16, with a typical range of from 20 to 35; for cationic diamines (b=1), n is at least about 12 with a typical range of from about 12 to about 42.

Other dispersants/anti-redeposition agents for use herein are described in EP-B-011965 and U.S. Pat. Nos. 4,659,802 and 4,664,848.

Suds Suppressing System

The detergent compositions of the invention or in one embodiment the particle herein, when formulated for use in machine washing compositions, may comprise a suds suppressing system present at a level of from 0.01% to 15%, preferably from 0.02% to 10%, most preferably from 0.05% to 3% by weight of the composition.

Suitable suds suppressing systems for use herein may comprise essentially any known antifoam compound, including, for example silicone antifoam compounds and 2-alkyl alcanol antifoam compounds.

By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

Other suitable antifoam compounds include, for example, high molecular weight fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters.

A preferred suds suppressing system comprises:

(a) antifoam compound, preferably silicone antifoam compound, most preferably a silicone antifoam compound comprising in combination
  (i) polydimethyl siloxane, at a level of from 50% to 99%, preferably 75% to 95% by weight of the silicone antifoam compound; and
  (ii) silica, at a level of from 1% to 50%, preferably 5% to 25% by weight of the silicone/silica antifoam compound;

wherein said silica/silicone antifoam compound is incorporated at a level of from 5% to 50%, preferably 10% to 40% by weight;

(b) a dispersant compound, most preferably comprising a silicone glycol rake copolymer with a polyoxyalkylene content of 72–78% and an ethylene oxide to propylene oxide ratio of from 1:0.9 to 1:1.1, at a level of from 0.5% to 10%, preferably 1% to 10% by weight; a particularly preferred silicone glycol rake copolymer of this type is DCO544, commercially available from DOW Corning under the tradename DCO544;

(c) an inert carrier fluid compound, most preferably comprising a $C_{16}$–$C_{18}$ ethoxylated alcohol with a degree of ethoxylation of from 5 to 50, preferably 8 to 15, at a level of from 5% to 80%, preferably 10% to 70%, by weight;

A highly preferred particulate suds suppressing system is described in EP-A-0210731 and comprises a silicone antifoam compound and an organic carrier material having a melting point in the range 50° C. to 85° C., wherein the organic carrier material comprises a monoester of glycerol and a fatty acid having a carbon chain containing from 12 to 20 carbon atoms. EP-A-0210721 discloses other preferred particulate suds suppressing systems wherein the organic carrier material is a fatty acid or alcohol having a carbon chain containing from 12 to 20 carbon atoms, or a mixture thereof, with a melting point of from 45° C. to 80° C.

Other highly preferred suds suppressing systems comprise polydimethylsiloxane or mixtures of silicone, such as polydimethylsiloxane, aluminosilicate and polycarboxylic polymers, such as copolymers of laic and acrylic acid.

Polymeric Dye Transfer Inhibiting Agents

The compositions herein or in one embodiment the particle herein may also comprise from 0.01% to 10%, preferably from 0.05% to 0.5% by weight of polymeric dye transfer inhibiting agents. They may also be present in or present as binding material to bind the light reflecting component, as described above.

The polymeric dye transfer inhibiting agents are preferably selected from polyamine N-oxide polymers, copolymers of N-vinylpyrrolidone and N-viylimidazole, polyvinylpyrrolidonepolymers or combinations thereof, whereby these polymers can be cross-linked polymers.

Polymeric Soil Release Agent

Polymeric soil release agents, herein after "SRA", can optionally be employed in the present compositions or reflecting particles. They may also be present in or present as binding material to bind the light reflecting component, as described above.

If utilized, SRA's will generally comprise from 0.01% to 10.0%, typically from 0.1% to 5%, preferably from 0.2% to 3.0% by weight, of the compositions.

Preferred SRA's typically have hydrophilic segments to hydrophiize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures.

Preferred SRA's include oligomeric terephthalate esters, typically prepared by processes involving at least one transerification/oligomerization, often with a metal catalyst such as a titanium(IV) alkoxide. Such esters may be made using additional monomers capable of being incorporated into the ester structure through one, two, three, four or more positions, without, of course, forming a densely crossinked overall structure.

Suitable SRA's include a sulfonated product of a substantially linear ester oligomer comprised of an oligomeric ester backbone of terephthaloyl and oxyalkyleneoxy repeat units and allyl-derived sulfonated terminal moieties covalently attached to the backbone, for example as described in U.S. Pat. No. 4,968,451, Nov. 6, 1990 to J. J. Scheibel and E. P. Gosselink. Such ester oligomers can be prepared by: (a) ethoxylating allyl alcohol; (b) reacting the product of (a) with dimethyl terephthalate ("DMT") and 1,2-propylene glycol ("PG") in a two-stage transesterification/oligomerization procedure; and (c) reacting the product of (b) with sodium metabisulfite in water. Other SRA's include the nonionic end-capped 1,2-propylene/polyoxyethylene terephthalate polyesters of U.S. Pat. No. 4,711,730, Dec. 8, 1987 to Gosselink et al., for example those produced by transesterification/oligomerization of poly(ethyleneglycol)methyl ether, DMT, PG and poly (ethyleneglycol) ("PEG"). Other examples of SRA's include: the partly- and fully-anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesul- fonate; the nonionic-capped block polyester oligomeric compounds of U.S. Pat. No. 4,702,857, Oct. 27, 1987 to Gosselink, for example produced from DMT, methyl (Me)-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al., the latter being typical of SRA's useful in both laundry and fabric conditioning products, an example being an ester composition made from m-sulfobenzoic acid monosodium salt, PG and DMT, optionally but preferably further comprising added PEG, e.g., PEG 3400.

SRA's also include: simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; the $C_1$–$C_4$ alkyl celluloses and $C_4$ hydroxyalkyl celluloses, see U.S. Pat. No. 4,000,093, Dec. 28, 1976 to Nicol, et al.; and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100 and METOLOSE SM200, which are the trade names of methyl cellulose ethers manufactured by Shin-etsu Kagaku Kogyo KK.

Additional classes of SRA's include: (I) nonionic terephthalates using diisocyanate coupling agents to link polymeric ester structures, see U.S. Pat. No. 4,201,824, Violland et al. and U.S. Pat. No. 4,240,918 Lagasse et al.; and (II) SRA's with carboxylate terminal groups made by adding trimellitic anhydride to known SRA's to convert terminal hydroxyl groups to trimellitate esters. With the proper selection of catalyst, the trimellitic anhydride forms linkages to the terminals of the polymer through an ester of the isolated carboxylic acid of trimellitic anhydride rather than by opening of the anhydride linkage. Either nonionic or anionic SRA's may be used as starting materials as long as they have hydroxyl terminal groups which may be esterified. See U.S. Pat. No. 4,525,524 Tung et al.. Other classes include: (III) anionic terephthalate-based SRA's of the urethane-linked variety, see U.S. Pat. No. 4,201,824, Violland et al.;

Other Optional Ingredients

Other optional ingredients suitable for inclusion in the compositions of the invention include perfumes and filler salts, with sodium sulfate being a preferred filler salt.

Highly preferred compositions contain from about 2% to about 10% by weight of an organic acid, preferably citric acid. Also, preferably combined with a carbonate salt, minor amounts (e.g., less than about 20% by weight) of neutralizing agents, buffering agents, phase regulants, hydrotropes, enzyme stabilizing agents, polyacids, suds regulants, opacifiers, anti-oxidants, bactericides can be present.

The tablets herein may comprise (additional) disintegrating agents and/or (additional) coating agents, as preferred ingredients.

EXAMPLE I

The following reflecting particles are preferred reflecting particle of the invention. The particles 1 and 2 are made by spraying a solution of the dye in water onto the particulate component, then dusting the wetted component with the reflecting component and the metal oxide, followed by drying the particle in a fluidised bed.

The particles 3, 4 and 5 are prepared by first applying the binder material onto the surface of the particular component, and subsequently applying the pigment component and optionally applying the additional binder.

The levels in the table are in weight % of the reflecting particle.

| Reflecting particle | 1 | 2 | 3 | 4 | 5 |
|---|---|---|---|---|---|
| particulate component | | | | | |
| sodium citrate dihydrate | 94 | 96.9 | | 86 | |
| sodium carbonate | | | | | 77 |
| sodium sulphate | | | 94 | | |
| binder | | | | | |
| PEG 1500 | | | 2 | 4 | |
| AE(5–15) | | | | | 5 |
| pigment component | | | | | |
| mica and $TiO_2$* (weight ratio typically 2:1 to 50:1) | 5 | 3 | | 7 | 10 |
| BiOCl and mica (weight ratio 1:2) | | | 3.5 | | |
| additional binder | | | | | |
| PEG 1500 | | | | 1 | |
| AE(5–15) | | | | | 5 |
| dye | 1 | 0.1 | 0.5 | 2 | 3 |

*Iriodin 183, 221, 223, 231 or 289 as available form Merck; BiOCl as available from Merck Abbreviations used in the Granular Detergent Composition Examples In the detergent compositions, the abbreviated component identifications have the following meanings:

| | |
|---|---|
| LAS | Sodium linear C11–13 alkyl benzene sulfonate |
| TAS | Sodium tallow alkyl sulfate |
| CxyAS | Sodium C1x–Cly alkyl sulfate |
| C46SAS | Sodium C14–C16 secondary (2,3) alkyl sulfate |
| CxyEzS | Sodium C1x–C1y alkyl sulfate condensed with z moles of ethylene oxide |
| CxyEz | C1x–C1y predominantly linear primary alcohol condensed with an average of z moles of ethylene oxide |
| QAS | R2.N + (CH3)2(C2H4OH) with R2 = C12–C14 |
| QAS 1 | R2.N + (CH3)2(C2H4OH) with R2 = C8–C11 |
| APA | C8–C10 amido propyl dimethyl amine |
| Soap | Sodium linear alkyl carboxylate derived from an 80/20 mixture of tallow and coconut fatty acids |
| STS | Sodium toluene sulphonate |
| CFAA | C12–C14 (coco) alkyl N-methyl glucamide |
| TFAA | C16–C18 alkyl N-methyl glucamide |
| TPKFA | C12–C14 topped whole cut fatty acids |
| STPP | Anhydrous sodium tripolyphosphate |
| TSPP | Tetrasodium pyrophosphate |
| Zeolite A | Hydrated sodium aluminosilicate of formula Na12(AlO2SiO2)12.27H2O having a primary particle size in the range from 0.1 to 10 micrometers (weight expressed on an anhydrous basis) |
| NaSKS-6 | Crystalline layered silicate of formula δ-Na2Si2O5 |
| Citric acid | Anhydrous citric acid |
| Borate | Sodium borate |
| Carbonate | Anydrous sodium carbonate with a particle size between 200 μm and 900 μm |
| Bicarbonate | Anhydrous sodium bicarbonate with a particle size distribution between 400 μm and 1200 μm |
| Silicate | Amorphous sodium silicate (SiO2:Na2O = 2.0:1) |
| Sulfate | Anhydrous sodium sulfate |
| Mg sulfate | Anhydrous magnesium sulfate |
| Citrate | Tri-sodium citrate dihydrate of activity 86.4% with a particle size distribution between 425 μm and 850 μm |
| MA/AA | Copolymer of 1:4 maleic/acrylic acid, average molecular weight about 70,000 |
| MA/AA (1) | Copolymer of 4:6 maleic/acrylic acid, average molecular weight about 10,000 |
| AA | Sodium polyacrylate polymer of average molecular weight 4,500 |
| CMC | Sodium carboxymethyl cellulose |
| Cellulose ether | Methyl cellulose ether with a degree of polymerization of 650 available from Shin Etsu Chemicals |
| Protease | Proteolytic enzyme, having 3.3% by weight of active enzyme, sold by NOVO Industries A/S under the tradename Savinase |
| Protease I | Proteolytic enzyme, having 4% by weight of active enzyme, as described in WO 95/10591, sold by Genencor Int. Inc. |
| Alcalase | Proteolytic enzyme, having 5.3% by weight of active enzyme, sold by NOVO Industries A/S |
| Cellulase | Cellulytic enzyme, having 0.23% by weight of active enzyme, sold by NOVO Industries A/S under the tradename Carezyme |
| Amylase | Amylolytic enzyme, having 1.6% by weight of active enzyme, sold by NOVO Industries A/S under the tradename Termamyl 120T |
| Lipase | Lipolytic enzyme, having 2.0% by weight of active enzyme, sold by NOVO Industries A/S under the tradename Lipolase |
| Lipase (1) | Lipolytic enzyme, having 2.0% by weight of active enzyme, sold by NOVO Industries A/S under the tradename Lipolase Ultra |
| Endolase | Endoglucanase enzyme, having 1.5% by weight of active enzyme, sold by NOVO Industries A/S |
| PB4 | Particle containing sodium perborate tetrahydrate of nominal formula NaBO2.3H2O, the particles having a weight average particle size of 950 microns, 85% particles having a particle size of from 850 microns to 950 microns |
| PB1 | Particle containing anhydrous sodium perborate bleach of nominal formula NaBO2.H2O2, the particles having a weight average particle size of 800 microns, 85% particles having a particle size of from 750 microns to 950 microns |
| Percarbonate | Particle containing sodium percarbonate of nominal formula 2Na2CO3.3H2O2, the particles having a weight average particle size of 850 microns, 95% particles having a particle size of from 750 microns to 950 microns |
| NOBS | Particle comprising nonanoyloxybenzene sulfonate in the form of the sodium salt, the particles having a weight average particle size of 750 microns to 900 microns |
| NAC-OBS | Particle comprising (6-nonamidocaproyl) oxybenzene sulfonate, the particles having a weight average particle size of from 825 microns to 875 microns |
| TAED I | Particle containing tetraacetylethylenediamine, the particles having a weight average particle size of from 700 microns to 1000 microns |

-continued

| | |
|---|---|
| TAED II | Tetraacetylethylenediamine of a particle size from 150 microns to 600 microns |
| DTPA | Diethylene triamine pentaacetic acid |
| DTPMP | Diethylene triamine penta (methylene phosphonate), marketed by Monsanto under the Tradename Dequest 2060 |
| Photoactivated | Sulfonated zinc phthlocyanine encapsulated in bleach (1) dextrin soluble polymer |
| Photoactivated | Sulfonated alumino phthlocyanine encapsulated in bleach (2) dextrin soluble polymer |
| Brightener 1 | Disodium 4,4'-bis(2-sulphostyryl)biphenyl |
| Brightener 2 | Disodium 4,4'-bis(4-anilino-6-morpholino-1.3.5-triazin-2-yl)amino) stilbene-2:2'disulfonate |
| EDDS | Ethylenediamine-N,N'-disuccinic acid, (S,S) isomer in the form of its sodium salt. |
| HEDP | 1,1-hydroxyethane diphosphonic acid |
| PEGx | Polyethylene glycol, with a molecular weight of x (typically 4,000) |
| PEO | Polyethylene oxide, with an average molecular weight of 50,000 |
| TEPAE | Tetraethylenepentaamine ethoxylate |
| PVI | Polyvinyl imidosole, with an average molecular weight of 20,000 |
| PVP | Polyvinylpyrolidone polymer, with an average molecular weight of 60,000 |
| PVNO | Polyvinylpyridine N-oxide polymer, with an average molecular weight of 50,000 |
| PVPVI | Copolymer of polyvinylpyrolidone and vinylimidazole, with an average molecular weight of 20,000 |
| QEA | bis((C2H5O)(C2H4O)n)(CH3)—N+—C6H12—N+—(CH3) bis((C2H5O)—(C2H4O))n, wherein n = from 20 to 30 |
| SRP 1 | Anionically end capped poly esters |
| SRP 2 | Diethoxylated poly (1,2 propylene terephtalate) short block polymer |
| PEI | Polyethyleneimine with an average molecular weight of 1800 and an average ethoxylation degree of 7 ethyleneoxy residues per nitrogen |
| Silicone antifoam | Polydimethylsiloxane foam controller with siloxane-oxyalkylene copolymer as dispersing agent with a ratio of said foam controller to said dispersing agent of 10:1 to 100:1 |
| Opacifier | Water based monostyrene latex mixture, sold by BASF Aktiengesellschaft under the tradename Lytron 621 |
| Wax | Paraffin wax |
| Reflecting particle | as made in example I above |
| Mica | Iriodin 183, 221 or 223 as available form Merck |

In the following examples all levels are quoted as % by weight of the composition:

TABLE I

The following compositions are in accordance with the invention.

| | A | B | C | D | E | F | G | H | I |
|---|---|---|---|---|---|---|---|---|---|
| Spray-dried Granules | | | | | | | | | |
| LAS | 10.0 | 10.0 | 15.0 | 5.0 | 5.0 | 10.0 | — | — | — |
| TAS | — | 1.0 | — | | | | — | — | — |
| MBAS | — | — | | 5.0 | 5.0 | | — | — | — |
| $C_{45}AS$ | — | — | 1.0 | | 2.0 | 2.0 | — | — | — |
| $C_{45}AE_3S$ | — | — | | 1.0 | | | — | — | — |
| QAS | | | 1.0 | 1.0 | | | — | — | — |
| DTPA, HEDP and/or EDDS | 0.3 | 0.3 | 0.5 | 0.3 | | | — | — | — |
| MgSO4 | 0.5 | 0.5 | 0.1 | — | | | — | — | — |
| Sodium citrate | — | — | — | 3.0 | 5.0 | | — | — | — |
| Sodium carbonate | 10.0 | 7.0 | 15.0 | | | 10.0 | — | — | — |
| Sodium sulphate | 5.0 | 5.0 | — | — | 5.0 | 3.0 | — | — | — |
| Sodium silicate 1.6R | — | — | — | — | 2.0 | | — | — | — |
| Zeolite A | 16.0 | 18.0 | 20.0 | 20.0 | — | — | — | — | — |
| SKS-6 | — | — | — | 3.0 | 5.0 | — | — | — | — |
| MA/AA or AA | 1.0 | 2.0 | 11.0 | — | — | 2.0 | — | — | — |
| PEG 4000 or 1500 | 5.0 | 2.0 | — | 1.0 | — | 1.0 | — | — | — |
| QEA | 1.0 | — | — | — | 1.0 | — | — | — | — |
| Brightener | 0.05 | 0.05 | 0.05 | — | 0.05 | — | — | — | — |
| Silicone oil | 0.01 | 0.01 | 0.01 | — | — | 0.01 | — | — | — |
| Mica/$TiO_2$/PEG 4000 or 1500 (4:1:2) | 1.0 | 0.5 | | | | 0.05 | | | |

TABLE I-continued

The following compositions are in accordance with the invention.

| | A | B | C | D | E | F | G | H | I |
|---|---|---|---|---|---|---|---|---|---|
| Agglomerate | | | | | | | | | |
| LAS | | | — | — | — | — | 2.0 | 2.0 | — |
| MBAS | | | — | — | — | — | — | — | 1.0 |
| $C_{45}AS$ | | | — | — | — | — | 2.0 | — | — |
| $AE_3$ | | | — | — | — | — | — | 1.0 | 0.5 |
| Carbonate | | | — | — | 4.0 | 1.0 | 1.0 | 1.0 | — |
| Sodium citrate | | | — | — | — | — | — | — | 5.0 |
| CFAA | | | | | — | — | — | — | — |
| Citric acid | | | — | — | — | 4.0 | — | 1.0 | 1.0 |
| QEA | | | — | — | — | 2.0 | 2.0 | 1.0 | — |
| SRP | | | — | — | — | 1.0 | 1.0 | 0.2 | — |
| Zeolite A | | | — | — | — | 15.0 | 26.0 | 15.0 | 16.0 |
| Sodium silicate | | | — | — | — | — | — | — | — |
| PEG | — | — | — | — | — | — | 4.0 | — | — |
| Builder Agglomerates | | | | | | | | | |
| SKS-6 | 6.0 | — | — | — | 6.0 | 3.0 | — | 7.0 | 10.0 |
| LAS | 4.0 | 5.0 | — | — | 5.0 | 3.0 | — | 10.0 | 12.0 |
| Dry-add particulate components | | | | | | | | | |
| Maleic acid/carbonate/bicarbonate | 8.0 | 10.0 | 10.0 | 4.0 | — | 8.0 | 2.0 | 2.0 | 4.0 |
| (40:20:40) | | | | | | | | | |
| QEA | — | — | — | 0.2 | 0.5 | — | — | — | — |
| NACAOBS | 3.0 | — | — | 4.5 | — | — | — | 2.5 | — |
| NOBS | 1.0 | 3.0 | 3.0 | — | — | — | — | — | 5.0 |
| TAED I | 2.5 | — | — | 1.5 | 2.5 | 6.5 | — | 1.5 | — |
| MBAS | — | — | — | 8.0 | — | — | 8.0 | — | 4.0 |
| LAS (flake) | 10.0 | 10.0 | — | — | — | — | — | 8.0 | — |
| Mica | 0.3 | — | — | — | — | — | — | — | 0.5 |
| Spray-on | | | | | | | | | |
| Brightener | 0.2 | 0.2 | 0.3 | 0.1 | 0.2 | 0.1 | — | 0.6 | 0.3 |
| AE7 | — | — | — | — | — | 0.5 | — | 0.7 | — |
| Perfume | 1.0 | 0.5 | 1.1 | 0.8 | 0.3 | 0.5 | 0.3 | 0.5 | — |
| Dry-add | | | | | | | | | |
| Citrate | — | — | 20.0 | 4.0 | — | 5.0 | 15.0 | — | 5.0 |
| Percarbonate | 15.0 | 3.0 | 6.0 | 10.0 | — | — | 24.0 | 18.0 | 5.0 |
| Perborate | — | — | — | — | 6.0 | 18.0 | — | — | — |
| Photobleach | 0.02 | 0.02 | 0.02 | 0.1 | 0.05 | — | 0.3 | — | 0.03 |
| Enzymes (cellulase, amylase, protease, lipase) | 1.3 | 0.3 | 0.5 | 0.5 | 0.8 | 2.0 | 0.5 | 0.16 | 0.2 |
| Carbonate | 0.0 | 10.0 | — | — | — | 5.0 | 8.0 | 10.0 | 5.0 |
| Perfume (encapsulated) | — | 0.5 | 0.5 | — | 0.3 | — | 0.2 | — | — |
| Suds suppressor | 1.0 | 0.6 | 0.3 | — | 0.10 | 0.5 | 1.0 | 0.3 | 1.2 |
| Soap | 0.5 | 0.2 | 0.3 | 3.0 | 0.5 | — | — | 0.3 | — |
| Citric acid | — | — | — | 6.0 | 6.0 | — | — | — | 5.0 |
| Reflecting particle 1, 2, 3, 4 or 5 | — | — | — | 1.0 | 3.0 | 0.5 | 1.0 | 1.5 | 2.0 |
| SKS-6 | — | — | — | 4.0 | — | — | — | 6.0 | — |
| Fillers up to 100% | | | | | | | | | |

TABLE II

The following compositions are in accordance with the invention.

| | A | B | C | D | E | F | G | H | I |
|---|---|---|---|---|---|---|---|---|---|
| Spray-Dried Granules | | | | | | | | | |
| LAS | 10.0 | 10.0 | 16.0 | 5.0 | 5.0 | 10.0 | — | — | — |
| TAS | — | 1.0 | — | | | | — | — | — |
| MBAS | — | — | — | 5.0 | 5.0 | | — | — | — |
| $C_{45}AS$ | — | — | 1.0 | | 2.0 | 2.0 | — | — | — |
| $C_{45}AE_3S$ | — | — | — | 1.0 | | | — | — | — |
| QAS | — | — | 1.0 | 1.0 | | | — | — | — |

TABLE II-continued

The following compositions are in accordance with the invention.

| | A | B | C | D | E | F | G | H | I |
|---|---|---|---|---|---|---|---|---|---|
| DTPA, HEDP and/or EDDS | 0.3 | 0.3 | 0.3 | 0.3 | | | — | — | — |
| MgSO4 | 0.5 | 0.4 | 0.1 | — | | | — | — | — |
| Sodium citrate | 10.0 | 12.0 | 17.0 | 3.0 | 5.0 | | — | — | — |
| Sodium carbonate | 15.0 | 8.0 | 15.0 | | | 10.0 | — | — | — |
| Sodium sulphate | 5.0 | 5.0 | — | — | 5.0 | 3.0 | — | — | — |
| Sodium silicate 1.6R | — | — | — | — | 2.0 | | — | — | — |
| Zeolite A | — | — | — | 2.0 | — | — | — | — | — |
| SKS-6 | — | — | — | 3.0 | 5.0 | — | — | — | — |
| MA/AA or AA | 1.0 | 2.0 | 10.0 | — | — | 2.0 | — | — | — |
| PEG 4000 | — | 2.0 | — | 1.0 | — | 1.0 | — | — | — |
| QEA | 1.0 | — | — | — | 1.0 | — | — | — | — |
| Brightener | 0.05 | 0.05 | 0.05 | — | 0.05 | — | — | — | — |
| Silicone oil | 0.01 | 0.01 | 0.01 | — | — | 0.01 | — | — | — |
| Mica/$TiO_2$/PEG 4000 or 1500 (reflecting coating; 4:1:4) | 2.0 | 1.0 | 0.2 | 0.5 | 2.0 | 0.1 | — | — | — |
| Agglomerate | | | | | | | | | |
| LAS | — | — | — | — | — | — | 2.0 | 2.0 | — |
| MBAS | — | — | — | — | — | — | — | — | 1.0 |
| $C_{45}$AS | — | — | — | — | — | — | 2.0 | — | — |
| $AE_3$ | — | — | — | — | — | — | — | 1.0 | 0.5 |
| Carbonate | — | — | — | — | — | 1.0 | 1.0 | 1.0 | — |
| Sodium citrate | — | — | — | — | — | — | — | — | 5.0 |
| CFAA | — | — | — | — | — | — | — | — | — |
| Citric acid | — | — | — | — | — | 4.0 | — | 1.0 | 1.0 |
| QEA | — | — | — | — | — | 2.0 | 2.0 | 1.0 | — |
| SRP | — | — | — | — | — | 1.0 | 1.0 | 0.2 | — |
| Zeolite A | — | — | — | — | — | 15.0 | 26.0 | 15.0 | 16.0 |
| Sodium silicate | — | — | — | — | — | — | — | — | — |
| PEG | — | — | — | — | — | — | 4.0 | — | — |
| TAED | | | | | | | 3.0 | | 1.5 |
| coating | | | | | | | | | |
| Mica/$TiO_2$/PEG 1500 (3:1:3) | — | | | | | 1.5 | 0.6 | 3.0 | 0.05 |
| Builder Agglomerate | | | | | | | | | |
| SKS-6 | 6.0 | 5.0 | — | — | 6.0 | 3.0 | — | 7.0 | 10.0 |
| LAS | 4.0 | 5.0 | — | — | 5.0 | 3.0 | — | 10.0 | 12.0 |
| Dry-add particulate components | | | | | | | | | |
| Maleic acid/carbonate/bicarbonate (40:20:40) | 8.0 | 10.0 | 4.0 | 4.0 | — | 8.0 | 2.0 | 2.0 | 4.0 |
| QEA | — | — | — | 0.2 | 0.5 | — | — | — | — |
| NACAOBS | 3.0 | — | — | 1.5 | — | — | — | 5.5 | — |
| NOBS/LOBS/DOBS | — | 3.0 | 3.0 | — | — | — | — | — | 5.0 |
| TAED I | 2.5 | — | — | 1.5 | 2.5 | 6.5 | — | 1.5 | — |
| MBAS | — | — | — | 8.0 | — | — | 8.0 | — | 4.0 |
| LAS (flake) | — | — | — | — | — | — | — | 8.0 | — |
| Spray-on | | | | | | | | | |
| Brightener | 0.2 | 0.2 | 0.3 | 0.1 | 0.2 | — | — | 0.6 | — |
| AE7 | — | — | — | — | — | 0.5 | — | 0.7 | — |
| Perfume | — | — | — | 0.8 | — | 0.5 | 0.8 | 0.5 | 1.0 |
| Dry-add | | | | | | | | | |
| Citrate | 4.0 | — | 3.0 | 4.0 | — | 5.0 | 15.0 | — | 5.0 |
| Percarbonate | 15.0 | 3.0 | 6.0 | 10.0 | — | — | 12.0 | 18.0 | 5.0 |
| Perborate | — | — | — | — | 6.0 | 18.0 | — | — | — |
| Photobleach | 0.02 | 0.02 | 0.02 | 0.1 | 0.05 | — | 0.3 | — | 0.03 |
| Enzymes (cellulase, amylase, protease, lipase | 1.5 | 0.3 | 0.5 | 0.5 | 0.8 | 2.0 | 0.5 | 0.16 | 0.2 |
| Carbonate | — | — | — | — | — | 5.0 | 8.0 | 10.0 | 5.0 |
| Perfume (encapsulated) | 0.6 | 0.5 | 0.5 | — | 0.3 | 0.5 | 0.2 | 0.1 | 0.6 |
| Suds suppressor | 1.0 | 0.6 | 0.3 | — | 0.10 | 0.5 | 1.0 | 0.3 | 1.2 |
| Soap | 0.5 | 0.2 | 0.3 | 3.0 | 0.5 | — | — | 0.3 | — |
| Citric acid | — | — | — | 6.0 | 6.0 | — | — | — | 5.0 |
| SKS-6 | — | — | — | 4.0 | — | — | — | 6.0 | — |

TABLE II-continued

| The following compositions are in accordance with the invention. | | | | | | | | | |
|---|---|---|---|---|---|---|---|---|---|
| | A | B | C | D | E | F | G | H | I |
| Reflecting particle 1, 2 or 3, 4 or 5 | 1.0 | 2.0 | — | — | 3.0 | 0.5 | — | — | 1.0 |
| Fillers up to 100% | | | | | | | | | |

TABLE III

| The following is a composition the form of a tablet, bar, extrudate or granule in accord with the invention. Formulation H and I are preferably in the form of an agglomerate of the individual detergent particles or dry-added ingredient, agglomerate with PEG or water respectively, to obtain a granule of mean particle size between 500 and 900 microns. | | | | | | | | | |
|---|---|---|---|---|---|---|---|---|---|
| | A | B | C | D | E | F | G | H | I |
| Sodium $C_{11}$–$C_{13}$ alkylbenzenesulfonate | 12.0 | 16.0 | 23.0 | 19.0 | 18.0 | 20.0 | 16.0 | 5.0 | 6.0 |
| Sodium $C_{14}$–$C_{15}$ alcohol sulfate | | 4.5 | — | | — | — | 4.0 | 6.0 | 5.0 |
| $C_{14}$–$C_{15}$ alcohol ethoxylate (0.5) sulfate | | | — | — | — | — | — | | |
| $C_{14}$–$C_{15}$ alcohol ethoxylate (3) sulfate | — | — | 2.0 | — | 1.0 | 1.0 | 1.0 | | |
| Sodium $C_{14}$–$C_{15}$ alcohol ethoxylate | 2.0 | 2.0 | — | 1.3 | — | — | 5.0 | | |
| $C_9$–$C_{14}$ alkyl dimethyl hydroxy ethyl quaternary ammonium salt | | | — | — | 1.0 | 0.5 | 2.0 | 0.5 | 0.5 |
| Tallow fatty acid | | | — | — | — | — | 1.0 | | |
| Tallow alcohol ethoxylate (50) | — | — | — | — | — | — | — | | |
| Sodium tripolyphosphate/ Zeolite | 23.0 | 25.0 | 14.0 | 22.0 | 20.0 | 10.0 | 20.0 | 20.0 | 18.0 |
| Sodium carbonate | 25.0 | 22.0 | 35.0 | 20.0 | 28.0 | 41.0 | 30.0 | 25.0 | 16.0 |
| Sodium Polyacrylate (45%) | 0.5 | 0.5 | 0.5 | 0.5 | — | — | — | | |
| Sodium polyacrylate/maleate polymer | — | — | 1.0 | 1.0 | 1.0 | 2.0 | 0.5 | 0.7 | 1.0 |
| Sodium silicate (1:6 ratio $NaO/SiO_2$)(46%) | 3.0 | 6.0 | 9.0 | 8.0 | 9.0 | 6.0 | 8.0 | 0.5 | — |
| Sodium sulfate | — | — | — | — | — | 2.0 | 3.0 | 5.0 | 5.0 |
| Sodium perborate/ percarbonate | 5.0 | 5.0 | 10.0 | — | 3.0 | 1.0 | — | 12.0 | 15.0 |
| Poly(ethyleneglycol), MW ~4000 (50%) | 1.5 | 1.5 | 1.0 | 1.0 | — | — | 0.5 | 2.0 | — |
| Sodium carboxy methyl cellulose | 1.0 | 1.0 | 1.0 | — | 0.5 | 0.5 | 0.5 | | |
| Citric acid or citric acid/ carbonate/bicarbonate particle | 5.0 | 2.0 | 6.0 | — | — | 3.0 | — | 7.0 | 5.5 |
| NOBS/NACA-OBS | — | 1.0 | — | — | 1.0 | 0.7 | — | 3.0 | 2.0 |
| TAED | 1.5 | 1.0 | 2.5 | — | 3.0 | 0.7 | — | 2.5 | 3.0 |
| SRP | 1.5 | 1.5 | 1.0 | 1.0 | — | 1.0 | — | 0.2 | 0.5 |
| Clay | — | — | — | 7.0 | 10.0 | 4.0 | — | — | — |
| Flocculating agent | — | — | — | 2.0 | 0.6 | 1.0 | — | | |
| Magnesium sulphate | — | — | — | — | — | 0.5 | 1.5 | 0.4 | 0.3 |
| Chelant | — | — | — | — | 0.8 | 0.6 | 1.0 | 0.8 | 0.5 |
| Enzymes, including amylase, cellulase, protease and lipase | — | — | — | — | 2.0 | 1.5 | 2.0 | 1.0 | 1.0 |
| Reflecting particle 1–5 | — | — | — | 1.0 | — | 3.0 | — | — | — |
| Mica/$TiO_2$/PEG 1500 coating agent (10:1:20) | 1.5 | 2.0 | 0.1 | 0.8 | 0.5 | — | 3.0 | 4.0 | 3.0 |
| Dyed speckle | — | — | 0.5 | — | 0.5 | — | — | 1.5 | — |
| soap | | | | | | | | | |
| QAS | — | — | — | 1.5 | — | — | 2.0 | 1.2 | 1.0 |
| suds suppressor | | | | | | | | 2.5 | 3.0 |
| NaSKS-6 | | | | | | | | 3.5 | 5.0 |
| minors, e.g. encapsulated perfume, spray-on perfume, PVP, PVPVI/PVNO, brightener, encapsulated photo-bleach | 2.0 | 1.0 | 1.0 | 1.0 | 2.5 | 1.5 | 1.0 | 2.0 | 2.5 |

TABLE V

The following are compositions in the form of a tablet, bar, extrudate or granule in accord with the invention.

| | A | B | C | D |
|---|---|---|---|---|
| Sodium $C_{11}$–$C_{13}$ alkylbenzenesulfonate | 23.0 | 13.0 | 20.0 | 18.0 |
| Sodium $C_{14}$–$C_{15}$ alcohol sulfate | — | 4.0 | — | — |
| Clay | 5.0 | — | — | — |
| Wax | 0.5 | — | — | — |
| $C_{14}$–$C_{15}$ alcohol ethoxylate sulfate | — | | — | 2.0 |
| Sodium $C_{14}$–$C_{15}$ alcohol ethoxylate ( | 2.5 | 3.5 | — | — |
| $C_9$–$C_{14}$ alkyl dimethyl hydroxy ethyl quaternary ammomium salt | | — | — | 0.5 |
| Tallow fatty acid | 0.5 | — | — | — |
| Tallow alcohol ethoxylate (50) | — | — | | 1.3 |
| Sodium tripolyphosphate | — | 41.0 | — | 20.0 |
| Zeolite A, hydrate (0.1–10 micron size) | 26.3 | — | 21.3 | — |
| Sodium carbonate | 24.0 | 22.0 | 35.0 | 27.0 |
| Sodium Polyacrylate (45%) | 2.4 | — | 2.7 | — |
| Sodium polyacrylate/maleate polymer | — | — | 1.0 | 2.5 |
| Sodium silicate (1.6 or 2 or 2.2 ratio $NaO/SiO_2$)(46%) | 4.0 | 7.0 | 2.0 | 6.0 |
| Sodium sulfate | — | 6.0 | 2.0 | — |
| Sodium perborate/ percarbonate | 8.0 | 4.0 | — | 12.0 |
| Poly(ethyleneglycol), MW ~4000 (50%) | 1.7 | 0.4 | 1.0 | — |
| Sodium carboxy methyl cellulose | 1.0 | — | — | 0.3 |
| Reflecting particle 1, 2 or 5 or mica/$TiO_2$ with PEG 1500 (5:1:20) | 0.5 | 2.0 | 5.0 | 3.0 |
| Citric acid | — | — | 3.0 | — |
| NOBS/DOBS | 1.2 | — | — | 1.0 |
| TAED | 0.6 | 1.5 | — | 3.0 |
| Perfume | 0.5 | 1.0 | 0.3 | 0.4 |
| Soil release polymer | — | 1.5 | 1.0 | 1.0 |
| Moisture | 7.5 | 3.1 | 6.1 | 7.3 |
| Magnesium sulphate | — | — | — | 1.0 |
| Chelant | — | — | — | 0.5 |
| speckle | 1.0 | — | — | — |
| Enzymes, including amylase, cellulase, protease and lipase | — | 1.0 | — | 1.5 |
| minors, e.g. brightener, photo-bleach | 1.0 | 1.0 | 1.0 | 1.0 |

What is claimed is:

1. A granular detergent composition comprising one or more granular detergent ingredients and a light reflecting particle, wherein the light reflecting particle comprises a particulate component comprising a metal salt and a light reflecting component comprising a mixture of mica and TiO2 having a weight ratio of from about 2:1 to about 50:1, or a mixture of BiOCl and mica at a weight ratio of about 1:2; and further wherein the light reflecting particle exhibits a specular visible light reflection which is of higher intensity than the specular visible light reflection of the particulate component.

2. The composition according to claim 1, wherein the light reflecting particle has a luster index exceeding the luster index of sodium citrate dihydrate, further wherein the sodium citrate particles have a particle size of from 335 microns to 600 microns and a mean particle size of 450 microns.

3. The composition according to claim 1, wherein the particulate component is selected from the group consisting of sodium citrate dihydrate, sodium carbonate, sodium sulphate, and mixtures thereof.

4. The composition according to claim 1, wherein the granular detergent ingredient selected from surfactants, builders, bleaching agent, enzymes, suds suppressors, and mixtures thereof.

5. The composition according to claim 1, wherein the light reflecting particle further comprises crystalline sodium citrate, citric acid, or mixtures thereof.

6. The composition according to claim 1 wherein the light reflecting particle further comprises a colorant.

7. The composition according to claim 1 wherein the light reflecting particle further comprises a binder material.

8. The composition according to claim 1 wherein the binder material is selected from the group consisting of nonionic surfactants, polyalkylene glycols, and mixtures thereof.

9. The composition according to claim 1, wherein the light reflecting particle is evenly applied on the surface of the detergent ingredient.

10. A detergent tablet or bar comprising the detergent particle of claim 1.

11. A light reflecting particle comprising a particulate component and a light reflecting component, wherein the particulate component comprising a metal salt; and the light reflecting component comprising a mixture of mica and TiO2 having a weight ratio of from about 2:1 to about 50:1, or a mixture of BiOCl and mica at a weight ratio of about 1:2; and further wherein the light reflecting particle exhibits a specular visible light reflection which is of higher intensity than the specular visible light reflection of the particulate component.

12. The particle according to claim 11, wherein the light reflecting particle has a luster index exceeding the luster index of sodium citrate dihydrate, further wherein the sodium citrate particles have a particle size of from 335 microns to 600 microns and a mean particle size of 450 microns.

13. The particle according to claim 11, wherein the particulate component is selected from the group consisting of sodium citrate dihydrate, sodium carbonate, sodium sulphate, and mixtures thereof.

14. The particle according to claim 11 wherein the light reflecting particle further comprises crystalline sodium citrate, citric acid, or mixtures thereof.

15. The particle according to claim 11 wherein the light reflecting particle further comprises a colorant.

16. The particle according to claim 11 wherein the light reflecting particle further comprises a binder material.

17. The particle according to claim 11 wherein the binder material is selected from the group consisting of nonionic surfactants, polyalkyl ne glycols, and mixtures thereof.

18. A detergent tablet or bar comprising a core comprising one or more particulate detergent ingredient and a surface comprising the light reflecting particles of claim 11.

* * * * *